US007628515B1

(12) United States Patent
Lee

(10) Patent No.: US 7,628,515 B1
(45) Date of Patent: Dec. 8, 2009

(54) LAMP SHADE THAT IS ASSEMBLED EASILY AND QUICKLY

(76) Inventor: Ting-Sheng Lee, 58, Ma Yuan West St., Taichung (TW)

( * ) Notice: Subject to any disclaimer, the term of this patent is extended or adjusted under 35 U.S.C. 154(b) by 0 days.

(21) Appl. No.: 11/825,574

(22) Filed: Jul. 9, 2007

(51) Int. Cl.
*F21V 1/06* (2006.01)

(52) U.S. Cl. ..... 362/352; 362/351; 362/354; 362/355; 362/361; 362/430

(58) Field of Classification Search ..... 362/351, 362/352, 354, 355, 361, 430, 450
See application file for complete search history.

(56) References Cited

U.S. PATENT DOCUMENTS 6,604,846 B2 * 8/2003 Strickland ..... 362/352
7,210,824 B2 * 5/2007 Lu ..... 362/352
2003/0142498 A1 * 7/2003 Lu ..... 362/352

* cited by examiner

*Primary Examiner*—Stephen F. Husar
*Assistant Examiner*—Jessica L McMillan
(74) *Attorney, Agent, or Firm*—Alan Kamrath; Kamrath & Associates PA

(57) ABSTRACT

A lamp shade includes a lower support ring, an upper support, a shade body, a plurality of connecting members, and a plurality of support bars. Each of the connecting members is formed with an opening and a protruding straddle portion. The straddle portion of each of the connecting members has an insertion slot and two breaches. Each of the distal ends of each of the support bars is formed with a protruding insert inserted through either one of the two breaches into the insertion slot of the respective connecting member of the upper support ring and the lower support ring respectively so that the insert of each of the support bars is inserted into the insertion slot of the respective connecting member easily and quickly.

17 Claims, 21 Drawing Sheets

LAMP SHADE THAT IS ASSEMBLED EASILY AND QUICKLY

BACKGROUND OF THE INVENTION

1. Field of the Invention

The present invention relates to a lamp shade and, more particularly, to a lamp shade that is foldable and detachable.

2. Description of the Related Art

A conventional lamp shade in accordance with the prior art shown in FIGS. 10-15 comprises a lower support ring "C", an upper support ring "A" located above the lower support ring "C", a plurality of lower connecting members "C1" secured on the lower support ring "C", a plurality of upper connecting members "A2" each secured on the upper support ring "A" and each formed with a slot "A3", and a plurality of support bars "B" each having a lower end pivotally mounted on a respective one of the lower connecting members "C1" and an upper end formed with an insert "B2" inserted into the slot "A3" of a respective one of the upper connecting members "A2". Each of the lower connecting members "C1" is formed with a clamping portion "C2" enclosed around the lower end of the respective support bar "B" and having two side walls each having a pivot hole "C3". The lower end of each of the support bars "B" has two opposite sides each formed with a pivot stub "B1" that is compressed into and pivotally mounted in the pivot hole "C3" of the clamping portion "C2" of the respective lower connecting member "C1".

In assembly, the insert "B2" of each of the support bars "B" is inserted into the slot "A3" of the respective upper connecting member "A2" only when the insert "B2" of each of the support bars "B" exactly aligns with the slot "A3" of the respective upper connecting member "A2". However, each of the lower connecting members "C1" is secured on the lower support ring "C" so that each of the support bars "B" is limited by the respective lower connecting member "C1", and the insert "B2" of each of the support bars "B" cannot be inserted into the slot "A3" of the respective upper connecting member "A2" easily and conveniently, thereby greatly causing inconvenience to the user in assembly of the support bars "B".

Another conventional lamp shade in accordance with the prior art shown in FIGS. 16-21 comprises a lower support ring "C", an upper support ring "A" located above the lower support ring "C", a plurality of lower connecting members "C1" secured on the lower support ring "C", a plurality of upper connecting members "A2" each secured on the upper support ring "A" and each formed with a locking boss "A4", and a plurality of support bars "B" each having a lower end pivotally mounted on a respective one of the lower connecting members "C1" and an upper end formed with a locking groove "B3" snapped onto the locking boss "A4" of a respective one of the upper connecting members "A2". Each of the lower connecting members "C1" is formed with a clamping portion "C2" enclosed around the lower end of the respective support bar "B" and having two side walls each having a pivot hole "C3". The lower end of each of the support bars "B" has two opposite sides each formed with a pivot stub "B1" that is compressed into and pivotally mounted in the pivot hole "C3" of the clamping portion "C2" of the respective lower connecting member "C1".

In assembly, the insert "B2" of each of the support bars "B" is inserted into the slot "A3" of the respective upper connecting member "A2" only when the insert "B2" of each of the support bars "B" exactly aligns with the slot "A3" of the respective upper connecting member "A2". However, each of the lower connecting members "C1" is secured on the lower support ring "C" so that each of the support bars "B" is limited by the respective lower connecting member "C1", and the insert "B2" of each of the support bars "B" cannot be inserted into the slot "A3" of the respective upper connecting member "A2" easily and conveniently, thereby greatly causing inconvenience to the user in assembly of the support bars "B".

BRIEF SUMMARY OF THE INVENTION

In accordance with the present invention, there is provided a lamp shade lamp shade, comprising a lower support ring, an upper support ring located above the lower support ring, a shade body mounted between the upper support ring and the lower support ring, a plurality of connecting members mounted on the upper support ring and the lower support ring respectively, and a plurality of support bars each mounted between the upper support ring and the lower support ring to support the shade body and each having two opposite distal ends each inserted into and swingable in a respective one of the connecting members of the upper support ring and the lower support ring respectively.

The primary objective of the present invention is to provide a lamp shade that is assembled easily and quickly.

Another objective of the present invention is to provide a lamp shade, wherein the insert of each of the support bars is inserted through either one of the two breaches into the insertion slot of the respective connecting member of the upper support ring and the lower support ring respectively so that the insert of each of the support bars is inserted into the insertion slot of the respective connecting member easily and quickly, thereby facilitating a user attaching each of the support bars onto the respective connecting member.

A further objective of the present invention is to provide a lamp shade, wherein the insert of each of the support bars is movable in a two-dimensional direction so that the insert of each of the support bars is inserted through either one of the two breaches into the insertion slot of the respective connecting member easily and conveniently, thereby facilitating assembly of the support bars onto the connecting members.

A further objective of the present invention is to provide a lamp shade, wherein the straddle portion of each of the connecting members has two breaches to allow insertion of the insert of each of the support bars into the insertion slot of the respective connecting member, thereby facilitating assembly of the support bars onto the connecting members.

A further objective of the present invention is to provide a lamp shade, wherein the support bars are mounted onto the connecting members by insertion without being clamped.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
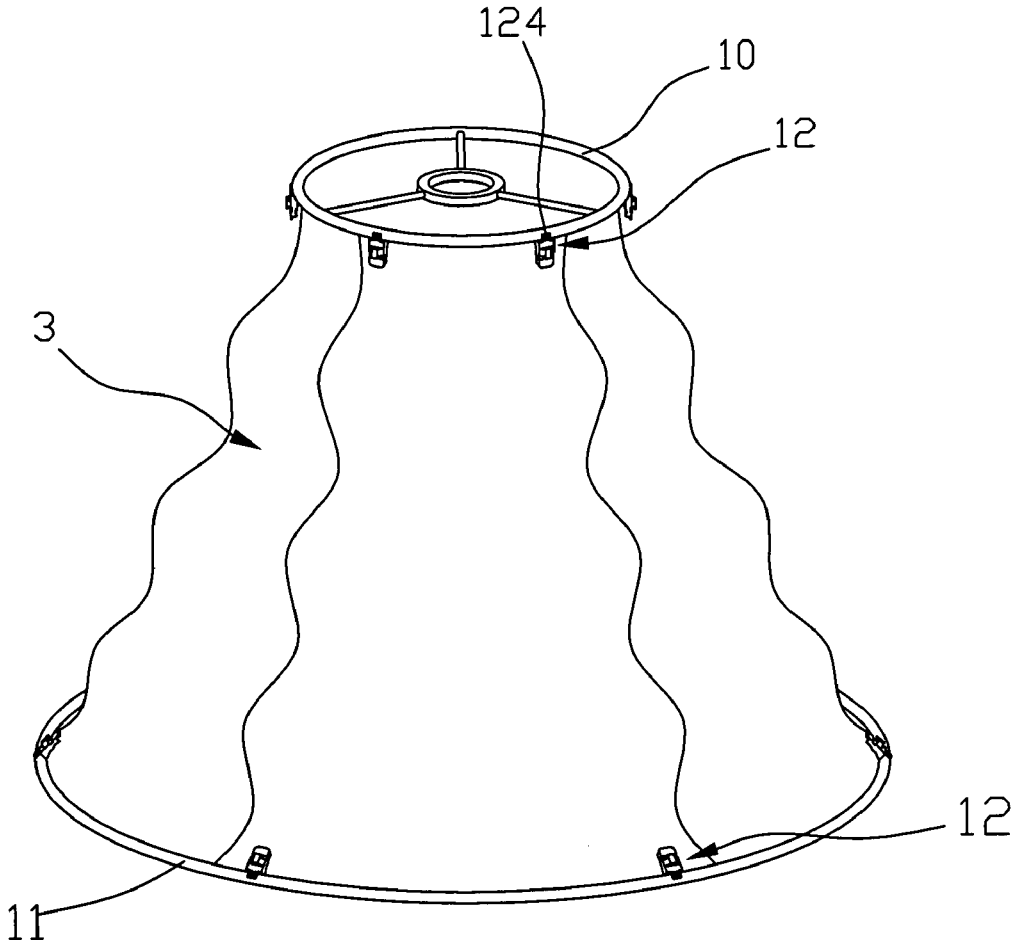
FIG. 1 is a perspective view of a lamp shade in accordance with the preferred embodiment of the present invention.
Figure 2:
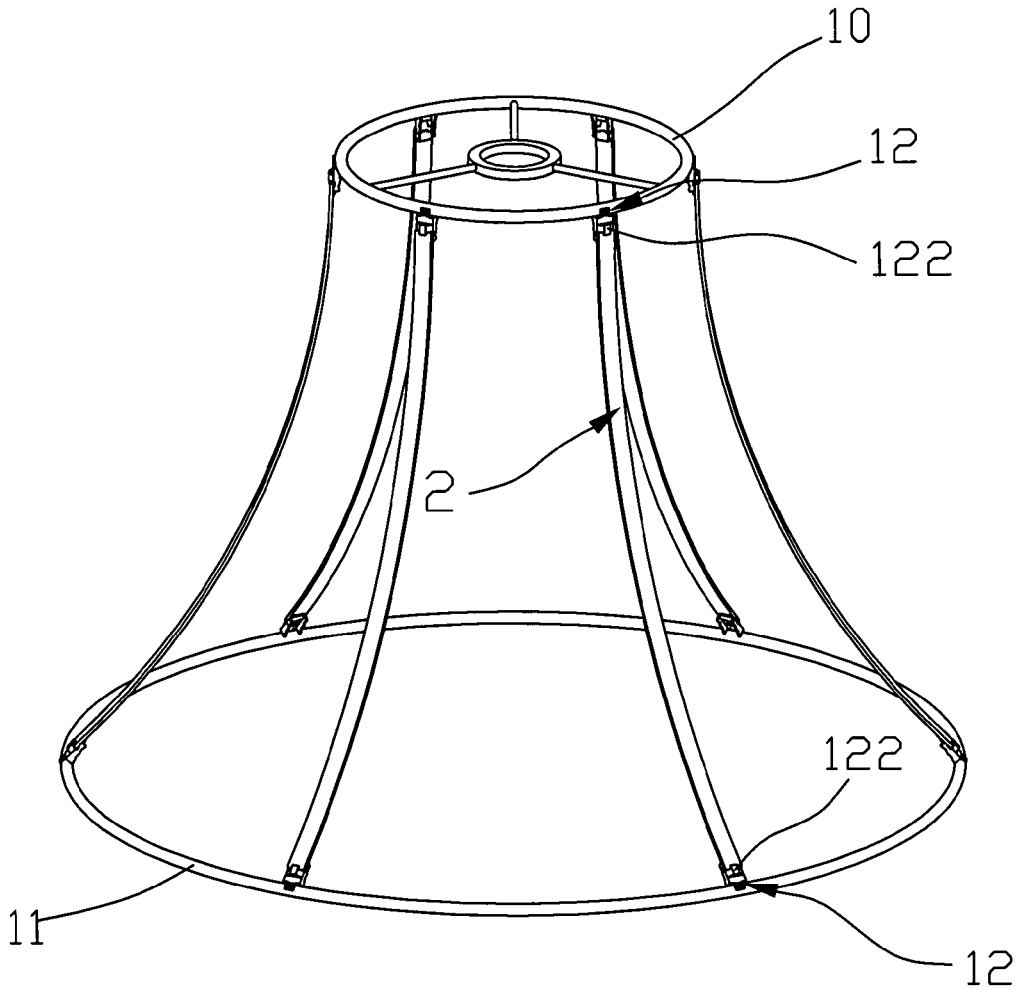
FIG. 2 is a partially perspective view of the lamp shade as shown in FIG. 1.
Figure 3:
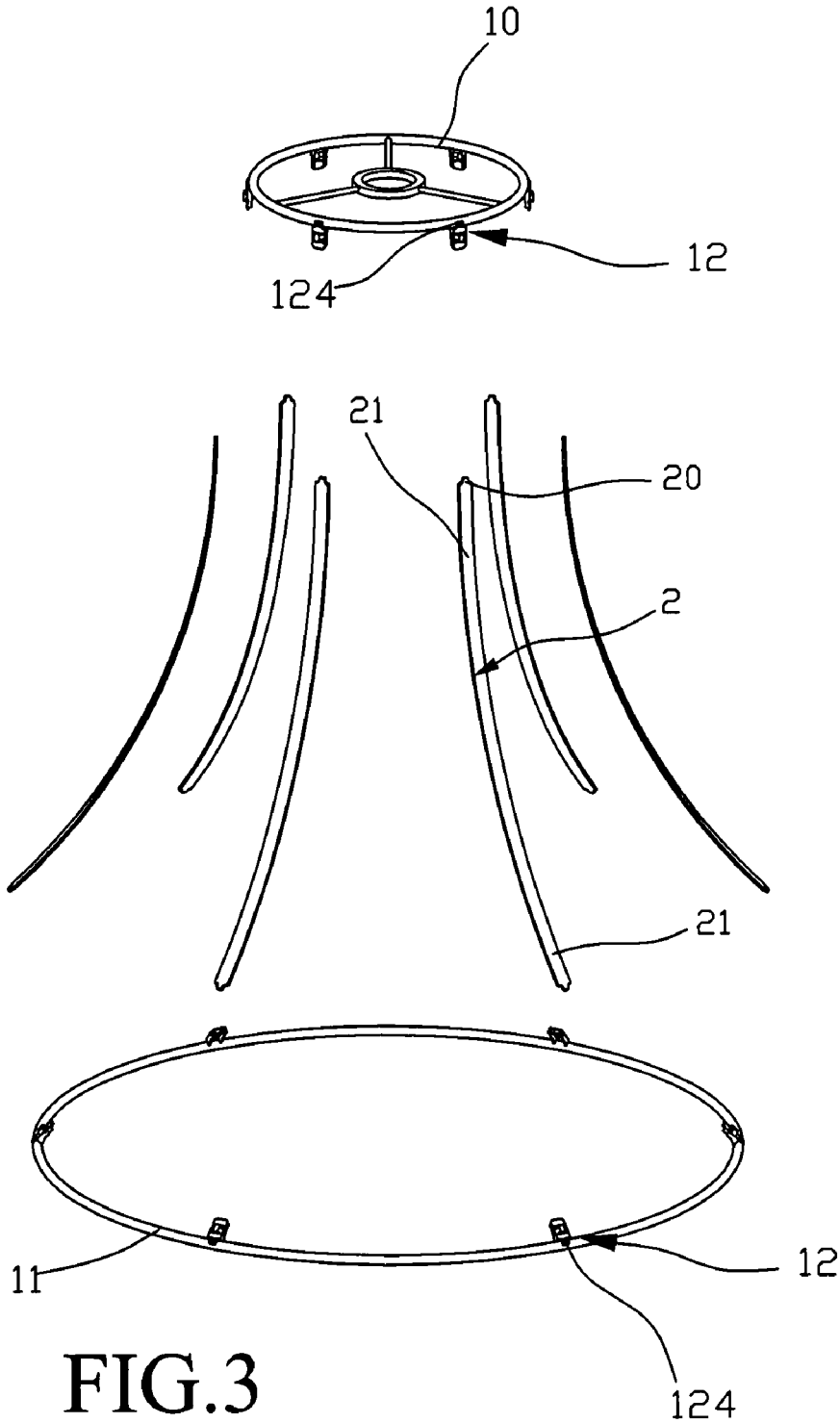
FIG. 3 is an exploded perspective view of the lamp shade as shown in FIG. 2.
Figure 4:
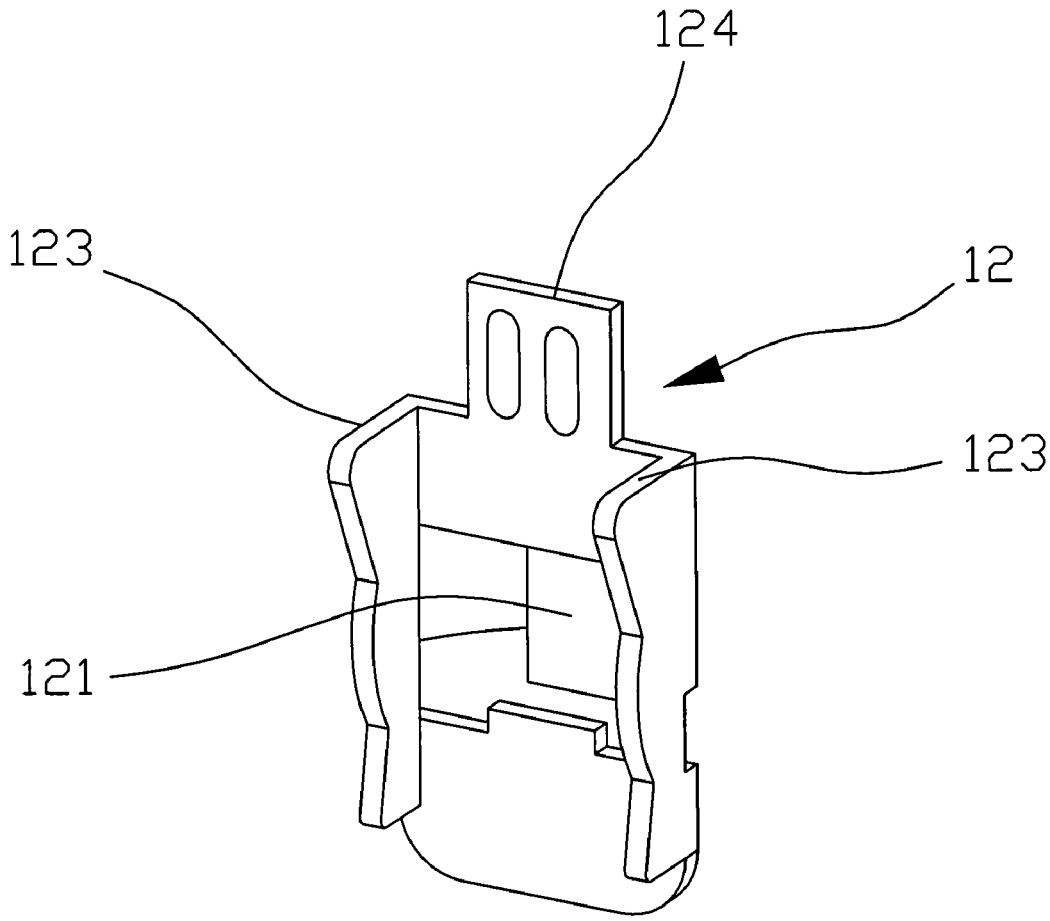
FIG. 4 is a perspective view of a connecting member of the lamp shade as shown in FIG. 3.
Figure 5:
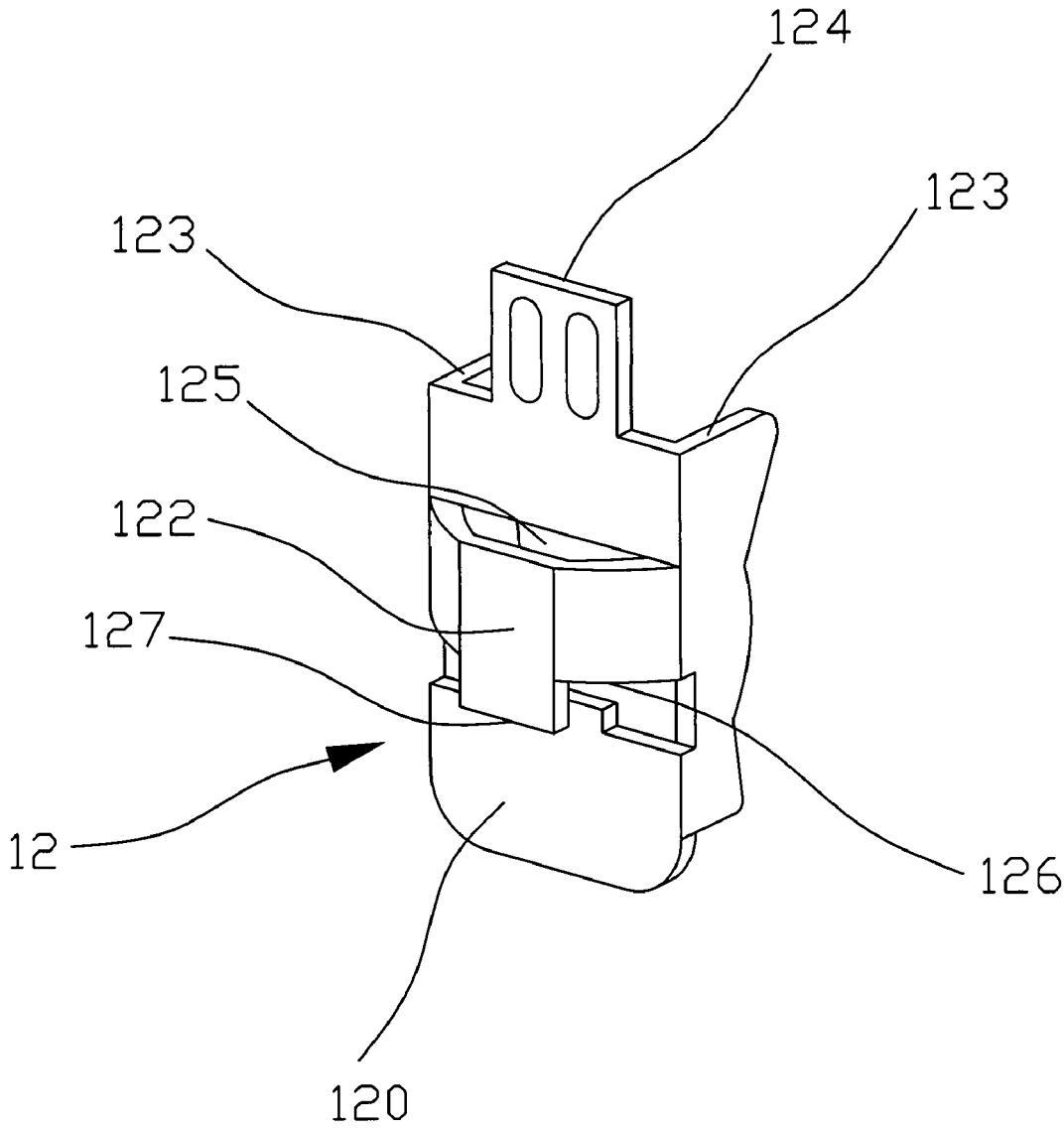
FIG. 5 is another perspective view of the connecting member of the lamp shade as shown in FIG. 3.

Referring to the drawings and initially to FIGS. 1-5, a lamp shade in accordance with the preferred embodiment of the present invention comprises a lower support ring 11, an upper support ring 10 located above the lower support ring 11, a shade body 3 mounted between the upper support ring 10 and the lower support ring 11, a plurality of connecting members 12 mounted on the upper support ring 10 and the lower support ring 11 respectively, and a plurality of support bars 2 each mounted between the upper support ring 10 and the lower support ring 11 to support the shade body 3 and each having two opposite distal ends 21 each inserted into and swingable in a respective one of the connecting members 12 of the upper support ring 10 and the lower support ring 11 respectively.

The connecting members 12 are equally spaced from each other. Each of the connecting members 12 is integrally formed by stamping a bent single metallic plate and has a substantially U-shaped cross-sectional profile. Each of the connecting members 12 has an end portion formed with a protruding connecting tongue 124 secured on a periphery of each of the upper support ring 10 and the lower support ring 11 respectively by spot welding. Each of the connecting members 12 has two opposite bent reinforcing walls 123 formed on two opposite sides thereof. Each of the reinforcing walls 123 of each of the connecting members 12 is perpendicular to the connecting tongue 124 and is rested on an inner rim of each of the upper support ring 10 and the lower support ring 11 respectively. The connecting tongue 124 has a width smaller than that of each of the connecting members 12 and is located between the reinforcing walls 123.

Each of the connecting members 12 is formed with an opening 121 and a protruding straddle portion 122 facing the opening 121. The straddle portion 122 of each of the connecting members 12 has a substantially arch-shaped cross-sectional profile and has an inside formed with a substantially sheath-shaped insertion slot 125 connected to the opening 121. The straddle portion 122 of each of the connecting members 12 has two breaches 126 formed on two opposite sides thereof and each connected to the insertion slot 125. The straddle portion 122 of each of the connecting members 12 is formed with a protruding catch portion 127 located between the two breaches 126 and extended in a direction opposite to that of the connecting tongue 124.

Each of the distal ends 21 of each of the support bars 2 is formed with a protruding reduced insert 20 inserted into the insertion slot 125 of the respective connecting member 12 of the upper support ring 10 and the lower support ring 11 respectively. The insert 20 of each of the support bars 2 is inserted through either one of the two breaches 126 into the insertion slot 125 of the respective connecting member 12. The insert 20 of each of the support bars 2 is slidable rightward and leftward in the insertion slot 125 of the respective connecting member 12 and is movable forward and rearward between the insertion slot 125 and the opening 121 of the respective connecting member 12 so that the insert 20 of each of the support bars 2 is movable in a two-dimensional direction.

Figure 6:
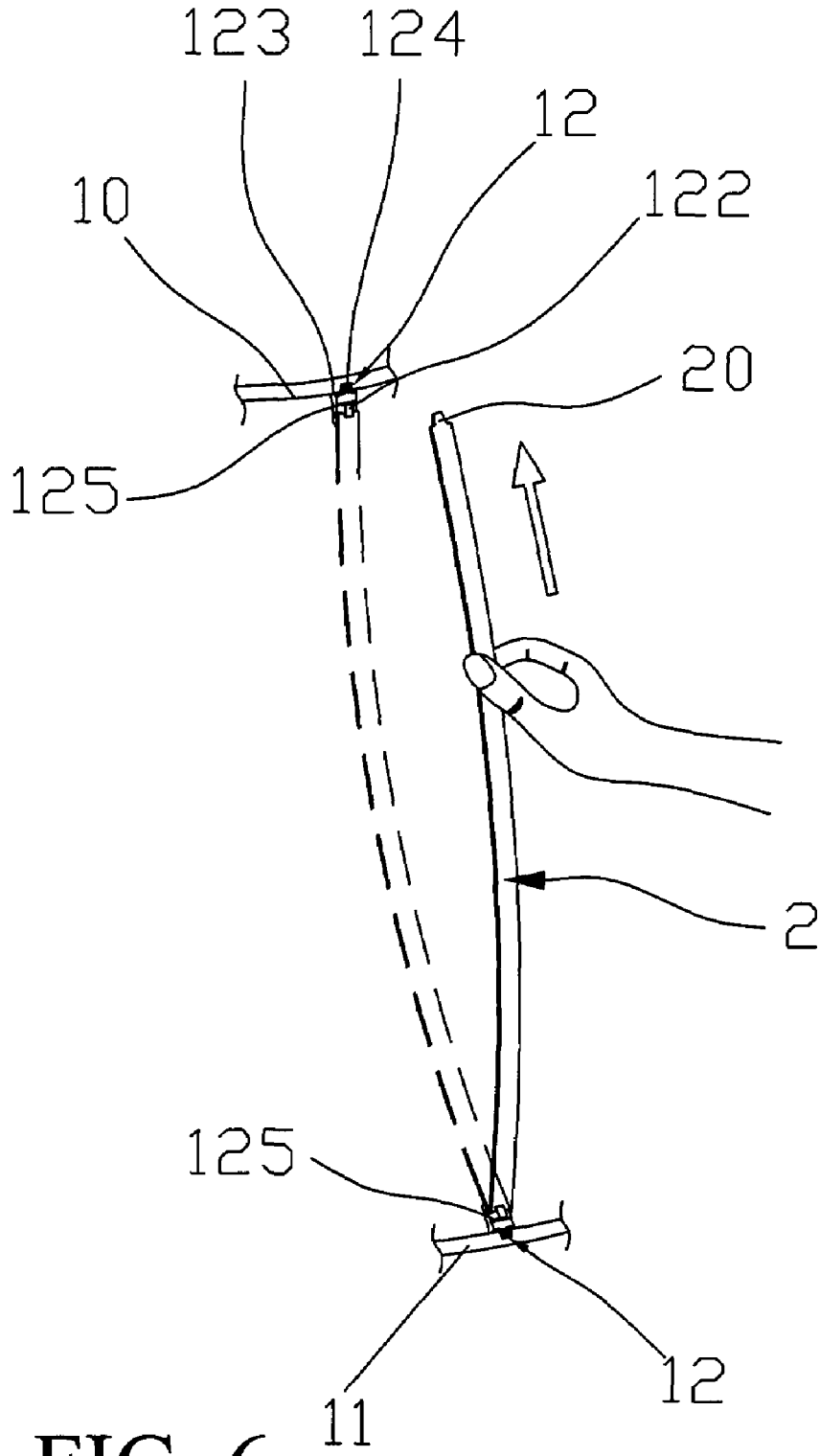
FIG. 6 is a schematic operational view of the lamp shade as shown in FIG. 2.

In operation, referring to FIG. 6 with reference to FIGS. 1-5, the lower insert 20 of each of the support bars 2 is initially inserted into the insertion slot 125 of the respective connecting member 12 of the lower support ring 11. Then, each of the support bars 2 is slightly bent, and the upper insert 20 of each of the support bars 2 is then inserted into the insertion slot 125 of the respective connecting member 12 of the upper support ring 10 so that each of the support bars 2 is located between the upper support ring 10 and the lower support ring 11. At this time, the insert 20 of each of the support bars 2 is stopped by the catch portion 127 of the respective connecting member 12 to prevent the insert 20 of each of the support bars 2 from being detached from the respective connecting member 12 of the upper support ring 10 and the lower support ring 11.

Figure 7:
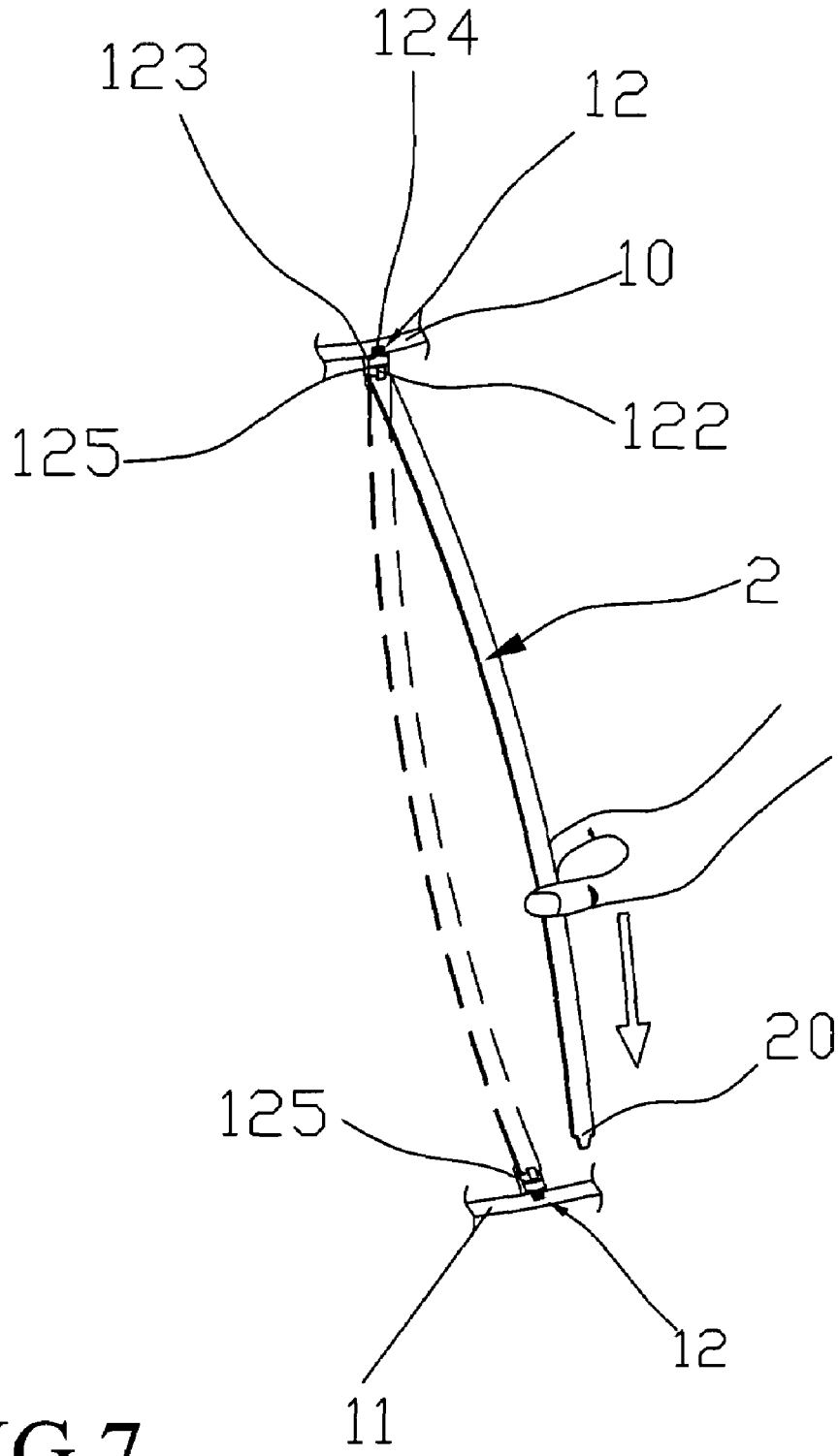
FIG. 7 is a schematic operational view of the lamp shade as shown in FIG. 2.

Referring to FIG. 7 with reference to FIGS. 1-5, the upper insert 20 of each of the support bars 2 is initially inserted into the insertion slot 125 of the respective connecting member 12 of the lower support ring 11. Then, each of the support bars 2 is slightly bent, and the lower insert 20 of each of the support bars 2 is then inserted into the insertion slot 125 of the respective connecting member 12 of the upper support ring 10 so that each of the support bars 2 is located between the upper support ring 10 and the lower support ring 11.

Figure 8:
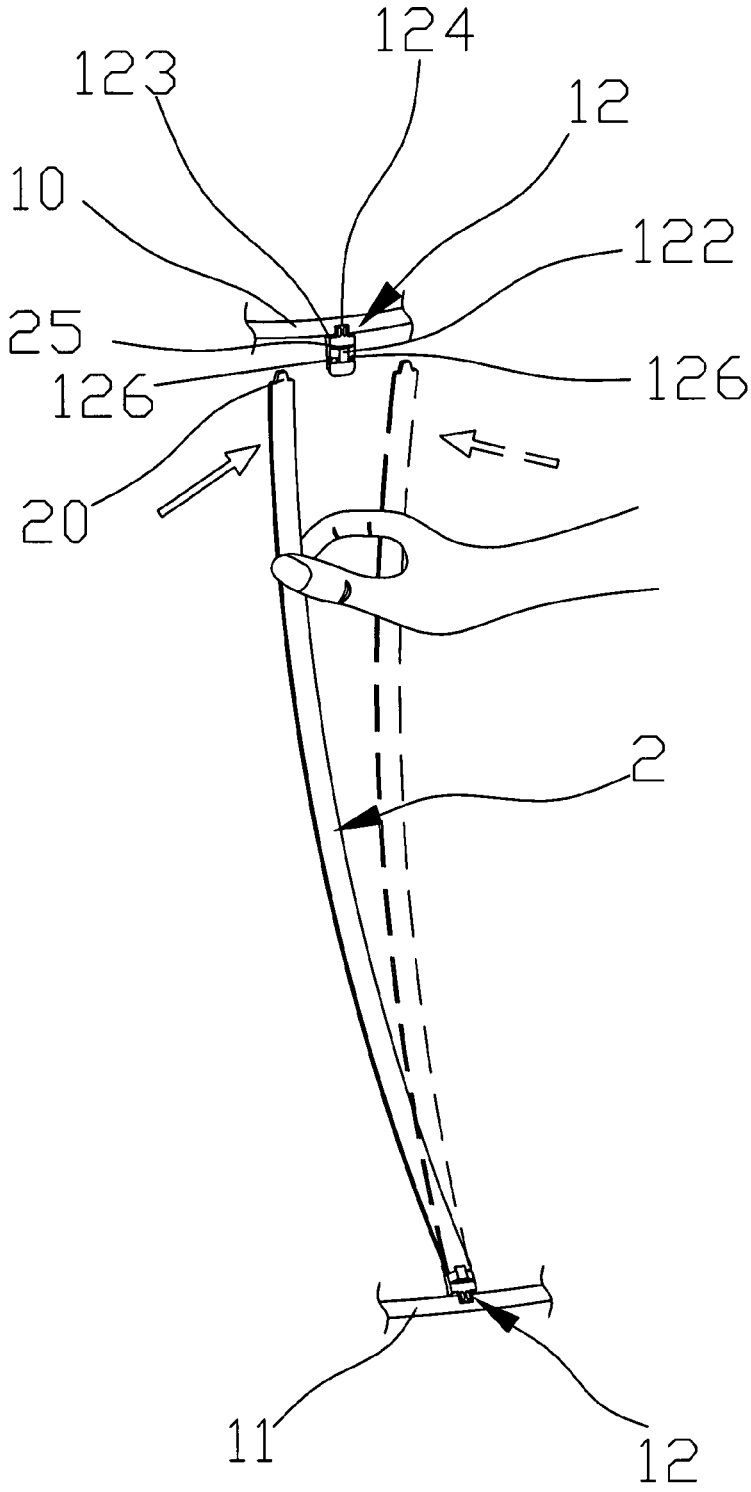
FIG. 8 is a schematic operational view of the lamp shade as shown in FIG. 2.
Figure 9:
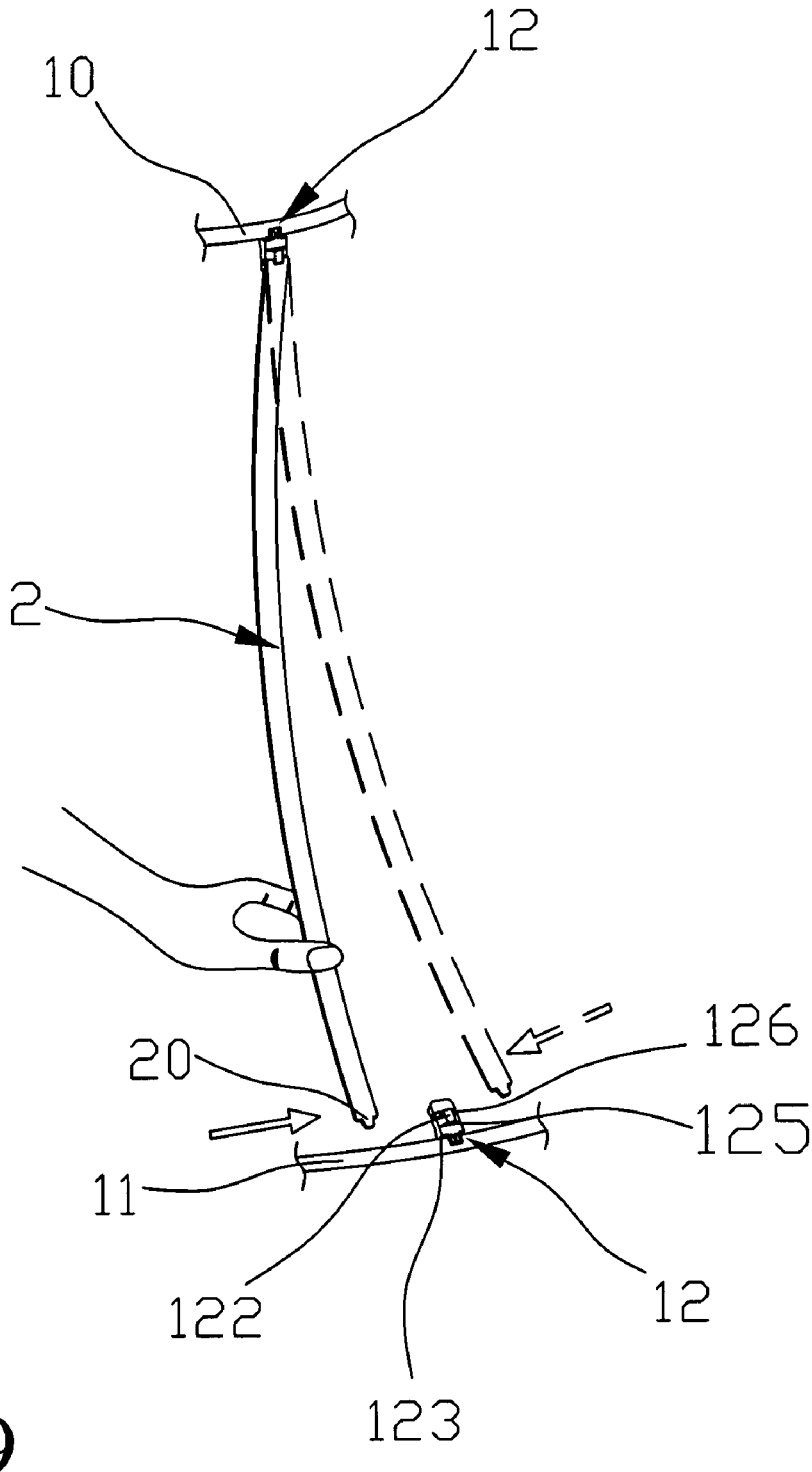
FIG. 9 is a schematic operational view of the lamp shade as shown in FIG. 2.
Figure 10:
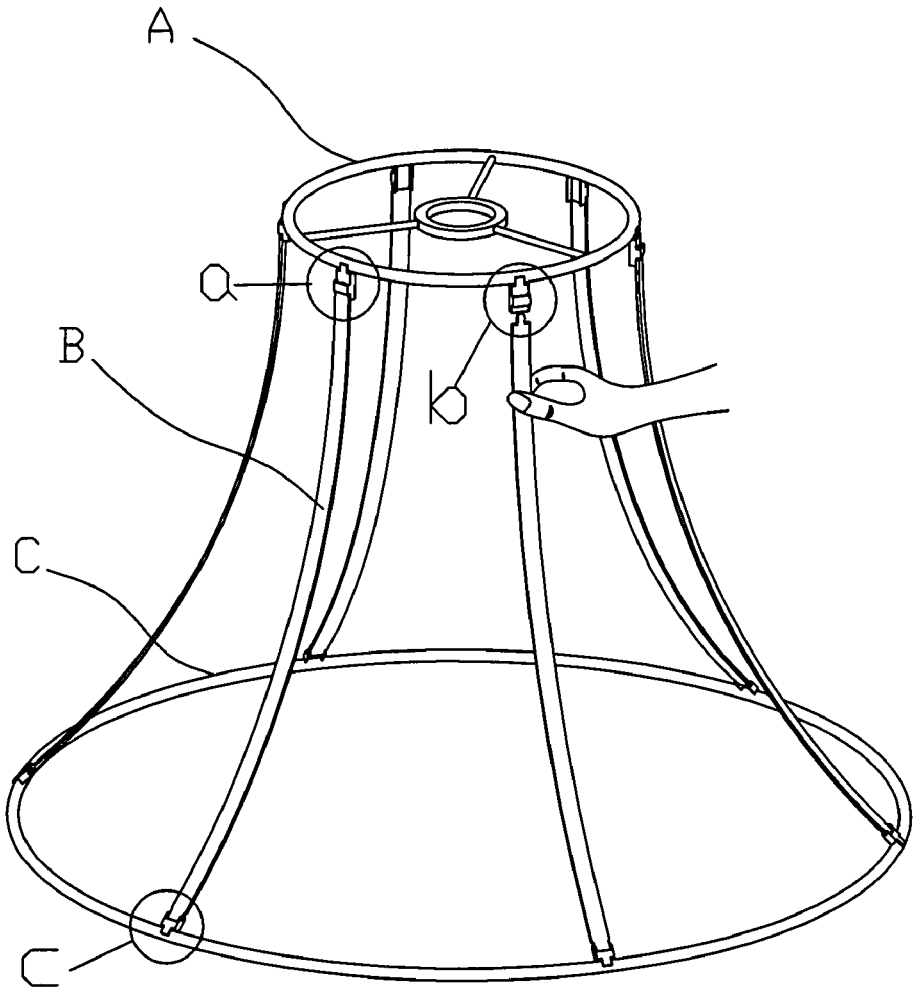
FIG.10 Prior Art
FIG. 10 is a perspective view of a conventional lamp shade in accordance with the prior art.
Figure 11:
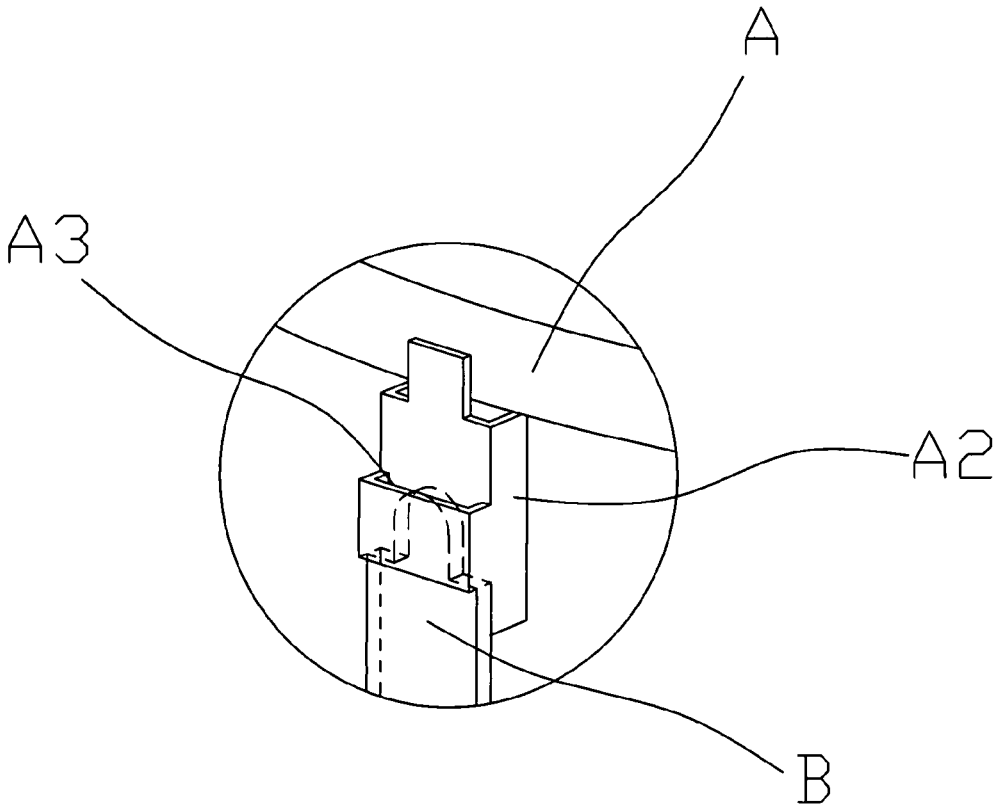
FIG. 11 Prior Art
FIG. 11 is a locally enlarged view of the conventional lamp shade taken along a circle "a" as shown in FIG. 10.
Figure 12:
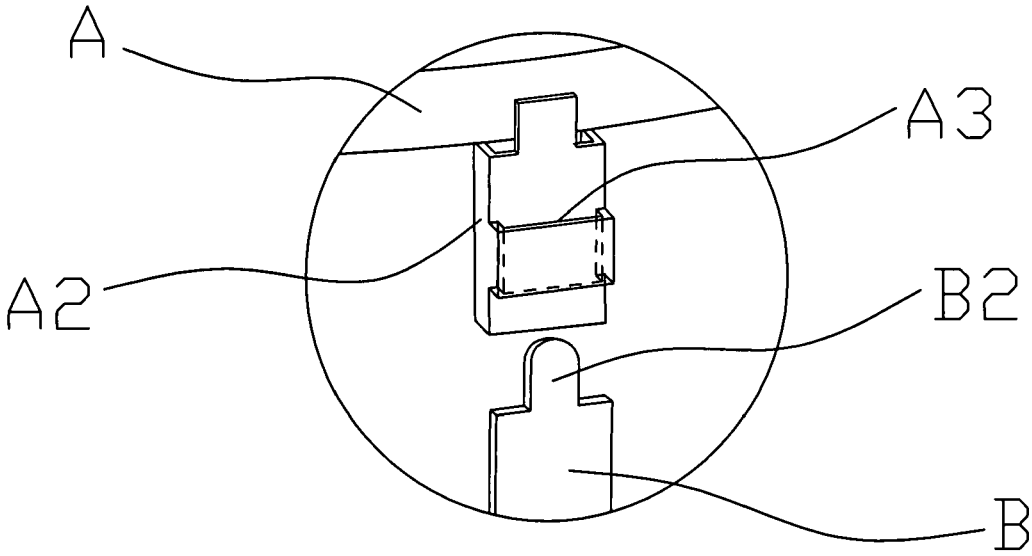
FIG. 12 Prior Art
FIG. 12 is a locally enlarged view of the conventional lamp shade taken along a circle "b" as shown in FIG. 10.
Figure 13:
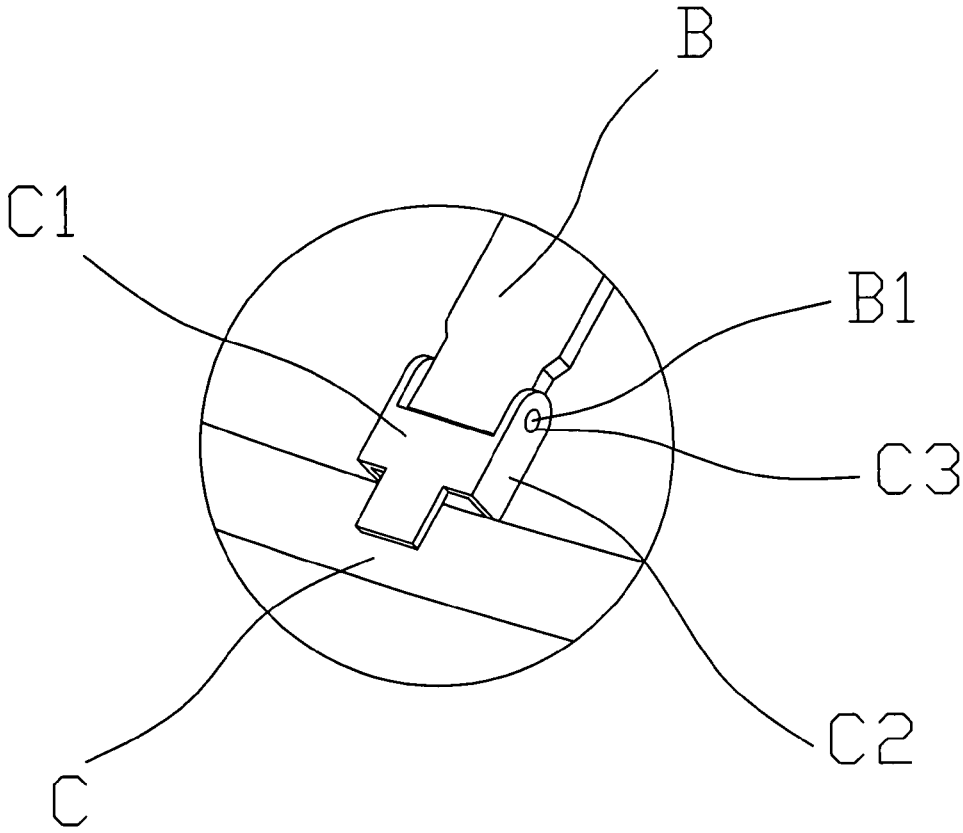
FIG. 13 Prior Art
FIG. 13 is a locally enlarged view of the conventional lamp shade taken along a circle "c" as shown in FIG. 10.
Figure 14:
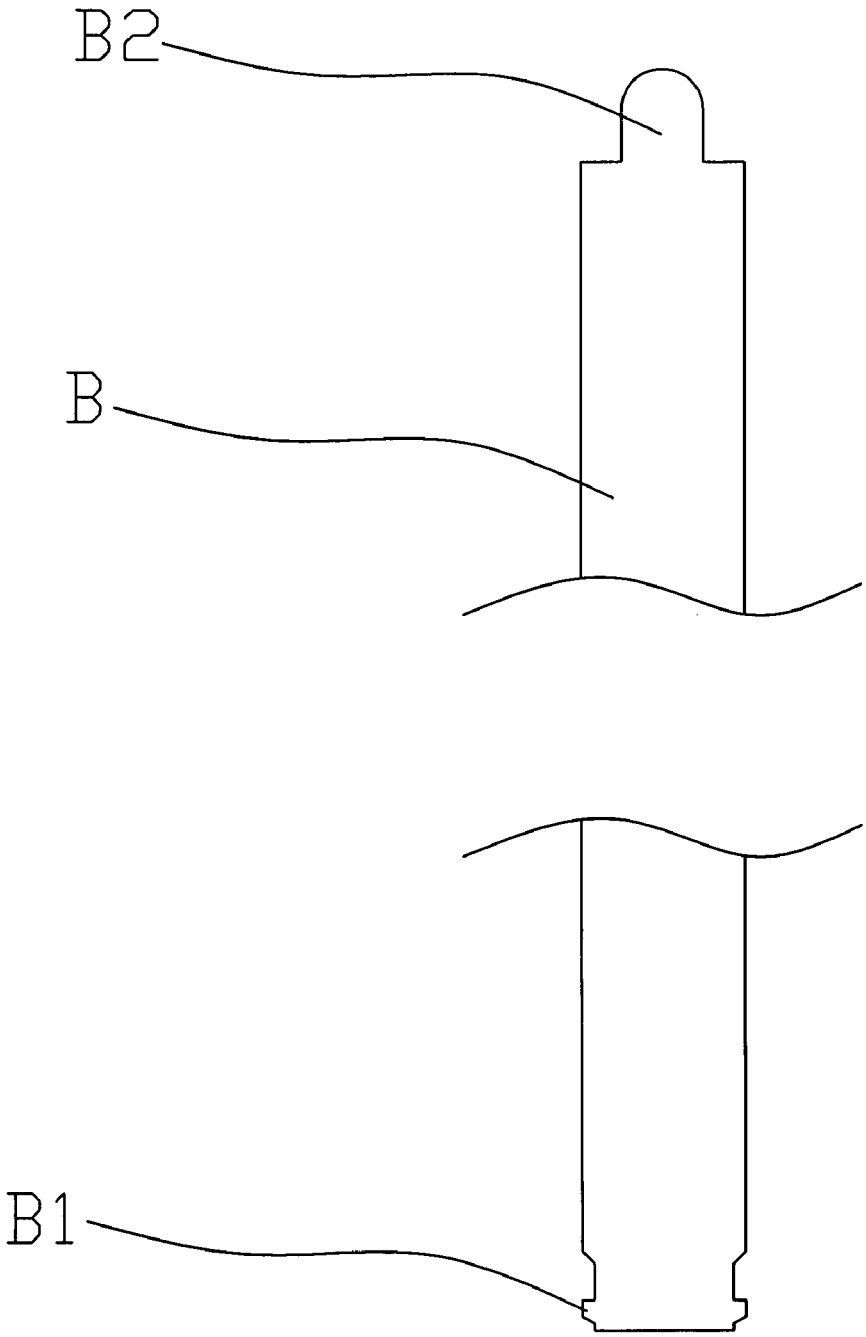
FIG. 14 Prior Art
FIG. 14 is a top view of a support bar of the conventional lamp shade as shown in FIG. 10.
Figure 15:
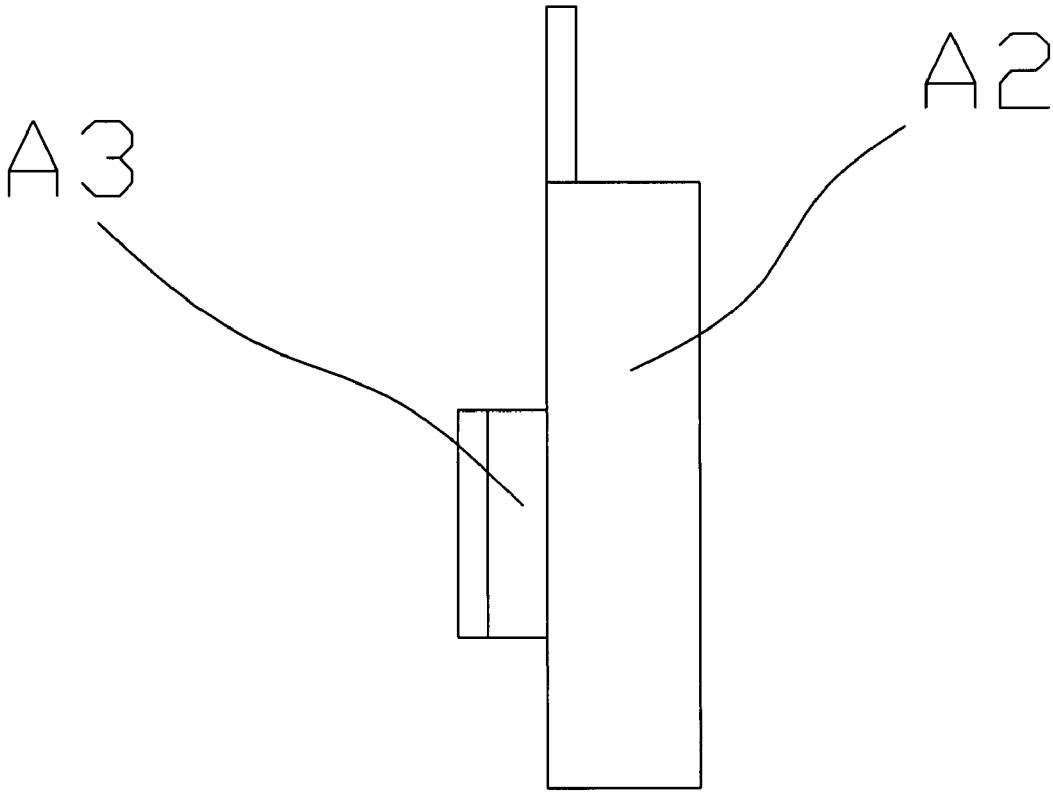
FIG. 15 Prior Art
FIG. 15 is a side view of an upper connecting member of the conventional lamp shade as shown in FIG. 12.
Figure 16:
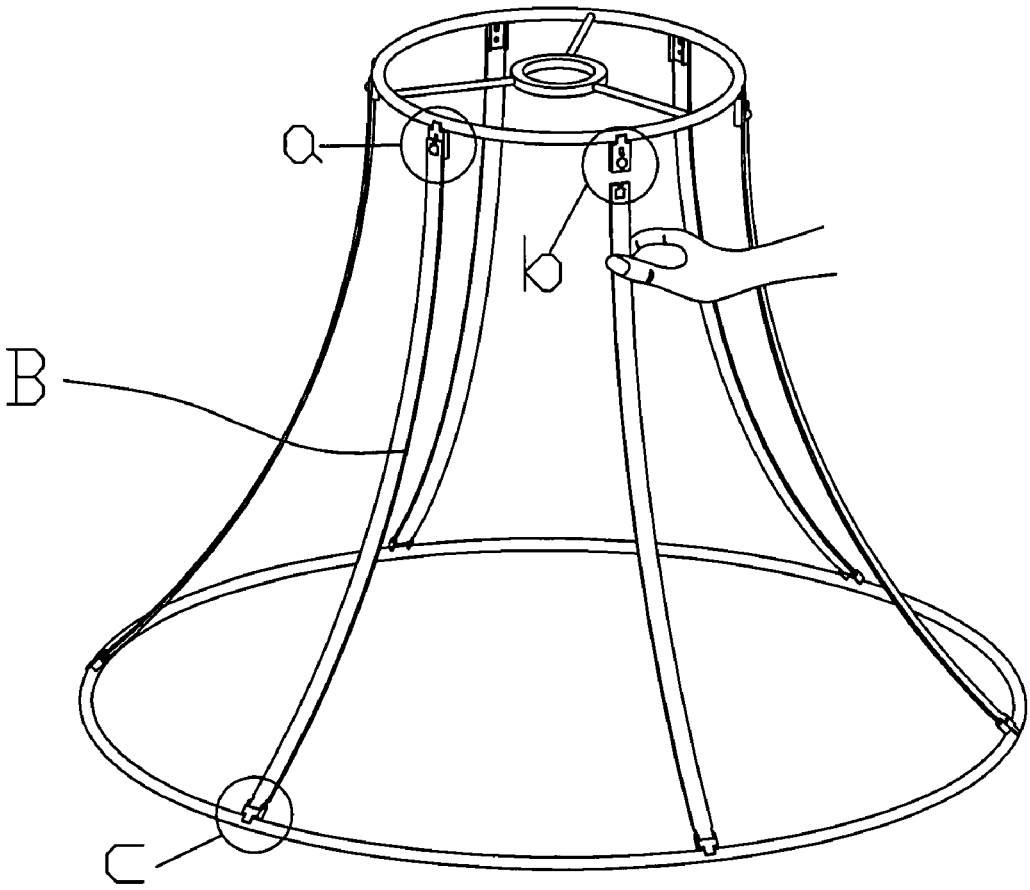
FIG. 16 Prior Art
FIG. 16 is a perspective view of another conventional lamp shade in accordance with the prior art.
Figure 17:
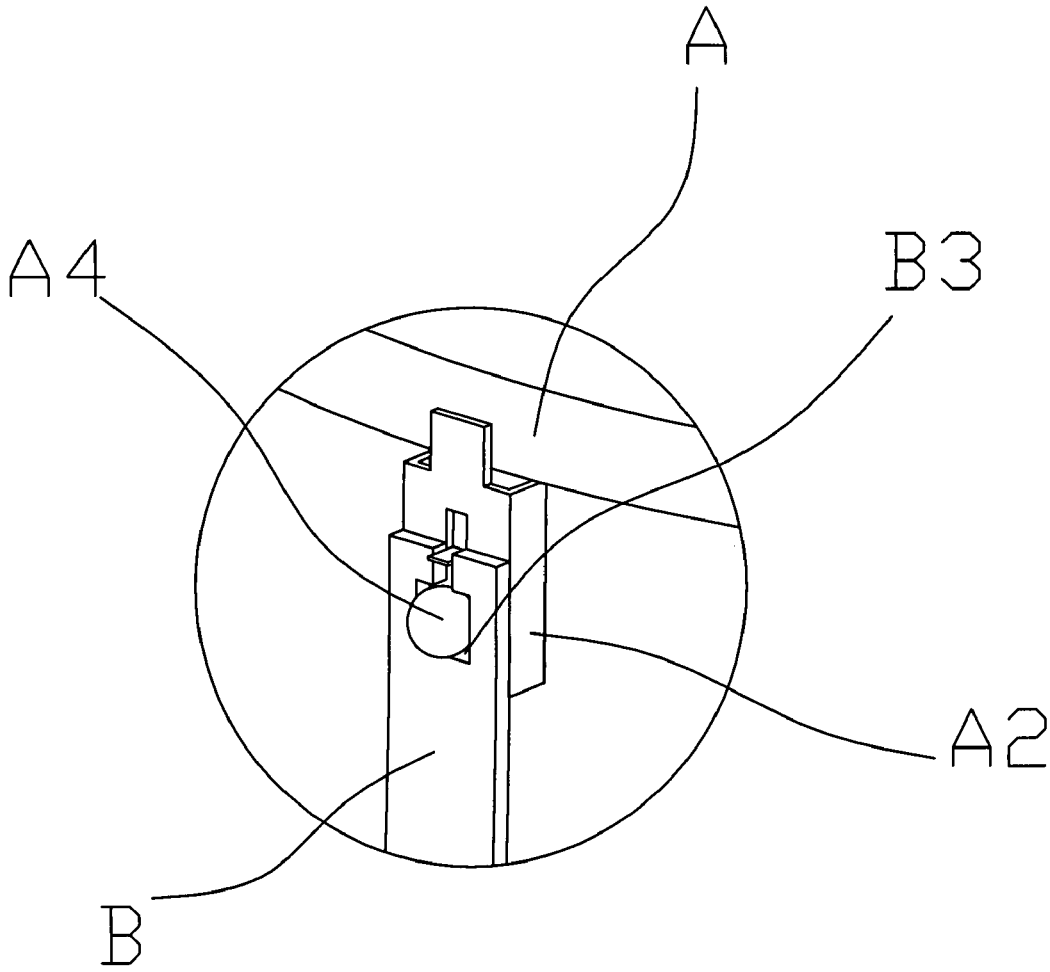
FIG.17 Prior Art
FIG. 17 is a locally enlarged view of the conventional lamp shade taken along a circle "a" as shown in FIG. 16.
Figure 18:
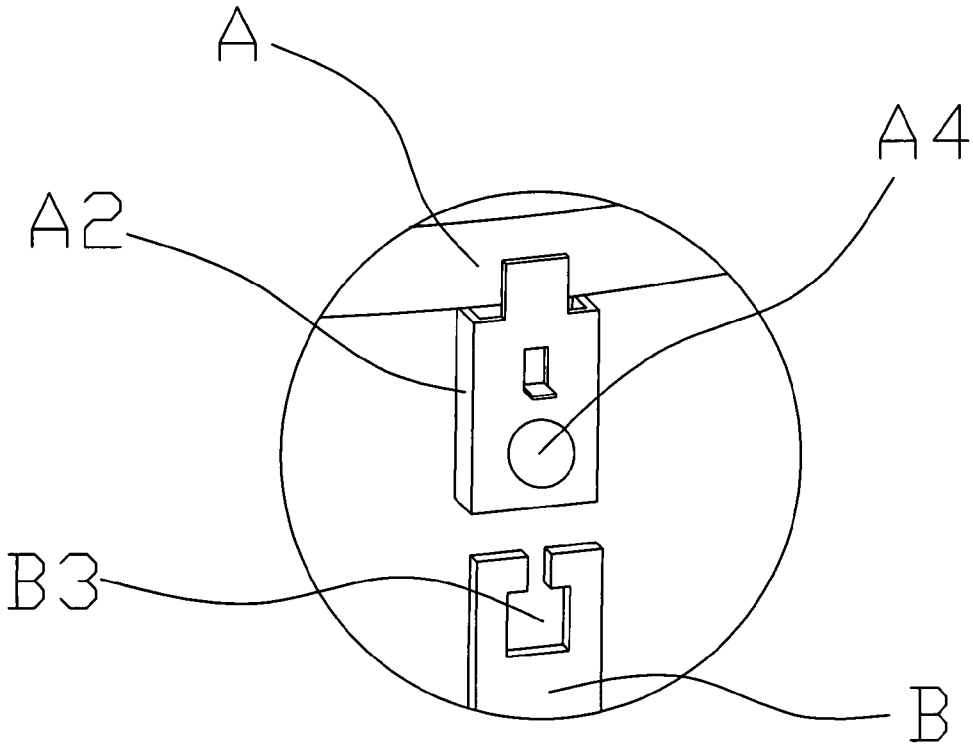
FIG.18 Prior Art
FIG. 18 is a locally enlarged view of the conventional lamp shade taken along a circle "b" as shown in FIG. 16.
Figure 19:
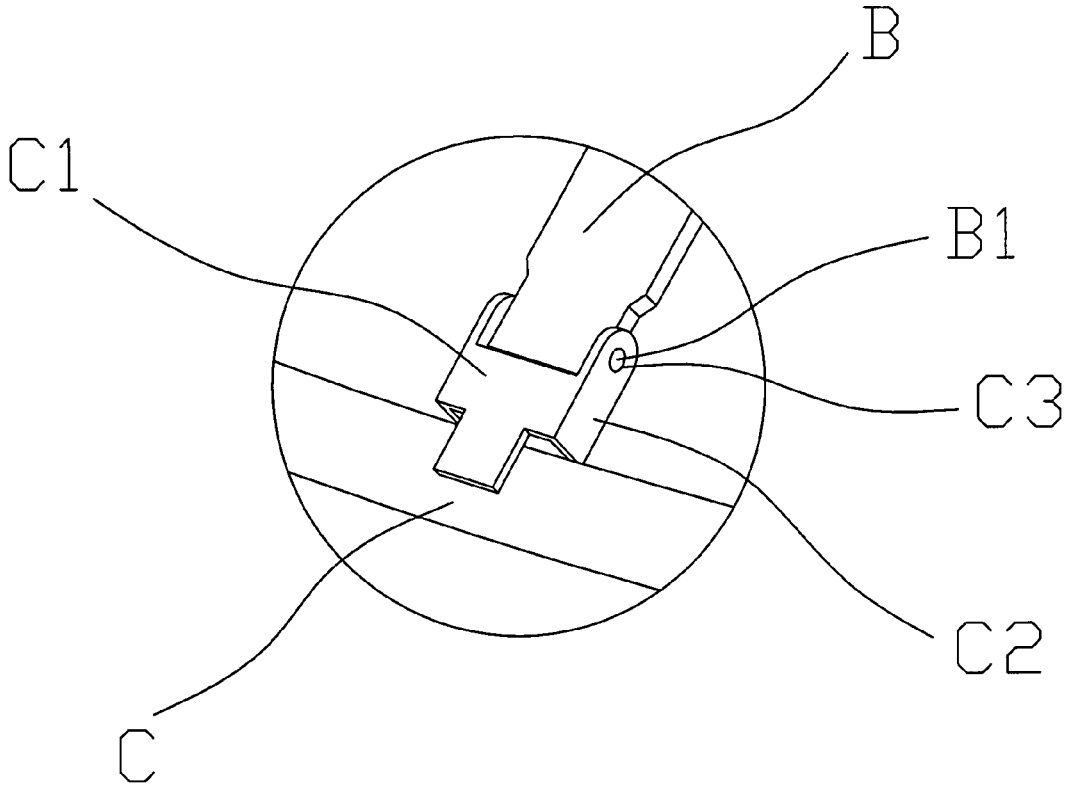
FIG. 19 Prior Art
FIG. 19 is a locally enlarged view of the conventional lamp shade taken along a circle "c" as shown in FIG. 16.
Figure 20:
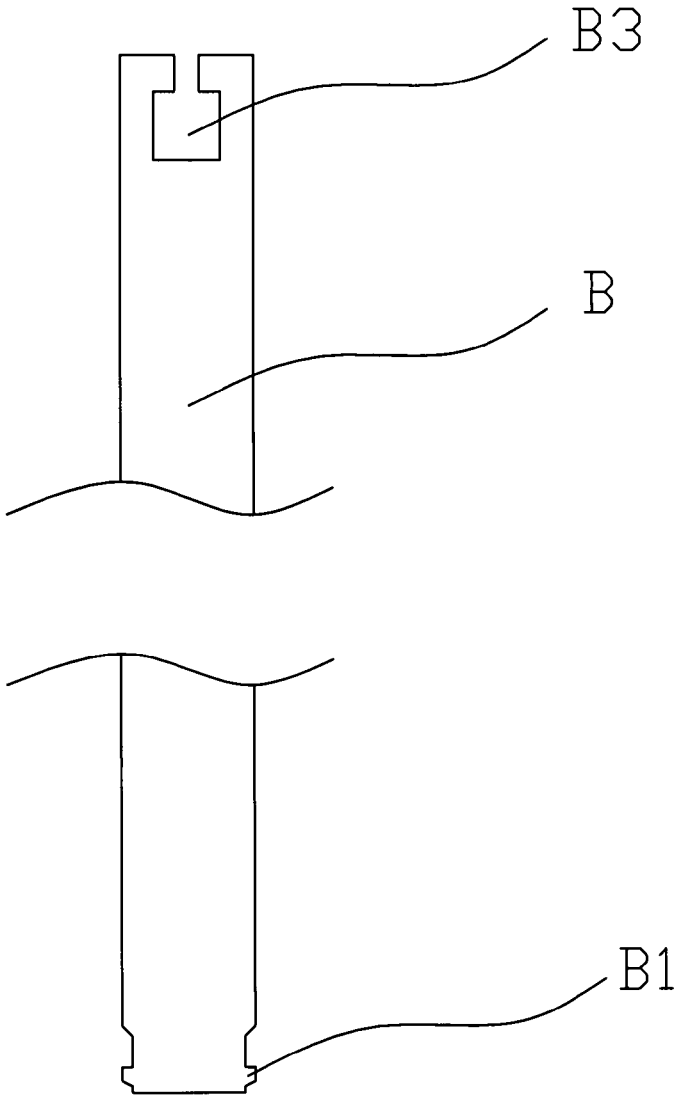
FIG. 20 Prior Art
FIG. 20 is a top view of a support bar of the conventional lamp shade as shown in FIG. 16.
Figure 21:
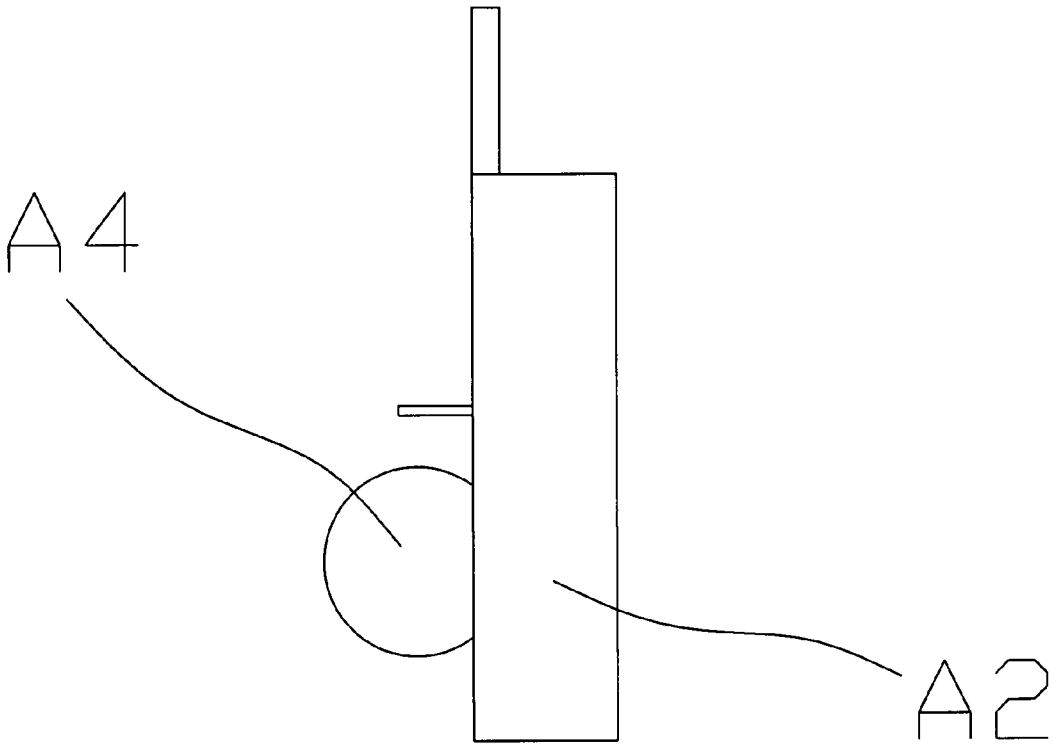
FIG. 21 Prior Art
FIG. 21 is a side view of an upper connecting member of the conventional lamp shade as shown in FIG. 18.

As shown in FIGS. 8 and 9, the insert 20 of each of the support bars 2 is inserted through either one of the two breaches 126 into the insertion slot 125 of the respective connecting member 12 of the upper support ring 10 and the lower support ring 11 respectively so that the insert 20 of each of the support bars 2 is inserted into the insertion slot 125 of the respective connecting member 12 easily and quickly, thereby facilitating a user attaching each of the support bars 2 onto the respective connecting member 12.

Accordingly, the insert 20 of each of the support bars 2 is inserted through either one of the two breaches 126 into the insertion slot 125 of the respective connecting member 12 of the upper support ring 10 and the lower support ring 11 respectively so that the insert 20 of each of the support bars 2 is inserted into the insertion slot 125 of the respective connecting member 12 easily and quickly, thereby facilitating a user attaching each of the support bars 2 onto the respective connecting member 12. In addition, the insert 20 of each of the support bars 2 is movable in a two-dimensional direction so that the insert 20 of each of the support bars 2 is inserted through either one of the two breaches 126 into the insertion slot 125 of the respective connecting member 12 easily and conveniently, thereby facilitating assembly of the support bars 2 onto the connecting members 12. Further, the straddle portion 122 of each of the connecting members 12 has two breaches 126 to allow insertion of the insert 20 of each of the support bars 2 into the insertion slot 125 of the respective connecting member 12, thereby facilitating assembly of the support bars 2 onto the connecting members 12. Further, the support bars 2 are mounted onto the connecting members 12 by insertion without being clamped.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lamp shade, comprising:

a lower support ring;

an upper support ring located above the lower support ring;

a shade body mounted between the upper support ring and the lower support ring;

a plurality of connecting members mounted on the upper support ring and the lower support ring respectively;

a plurality of support bars each mounted between the upper support ring and the lower support ring to support the shade body and each having two opposite distal ends each inserted into and swingable in a respective one of the connecting members of the upper support ring and the lower support ring respectively; wherein each of the connecting members is formed with an opening and a protruding straddle portion located opposite to the opening and facing the opening;

the straddle portion of each of the connecting members has an inside formed with an insertion slot;

each of the distal ends of each of the support bars is formed with a protruding insert inserted into the insertion slot of the respective connecting member of the upper support ring and the lower support ring respectively;

the straddle portion of each of the connecting members has two breaches formed on two opposite sides thereof and each connected to the insertion slot;

the insert of each of the support bars is inserted through either one of the two breaches into the insertion slot of the respective connecting member.

2. The lamp shade in accordance with claim 1, wherein the straddle portion of each of the connecting members is formed with a protruding catch portion located at and extended outwardly from a middle position of the straddle portion between the two breaches, and the catch portion of each of the connecting members is located outside of the insertion slot of the straddle portion and abuts the insert of the respective support bar.

3. The lamp shade in accordance with claim 2, wherein each of the connecting members has an end portion formed with a protruding connecting tongue spaced from the straddle portion and secured on a periphery of each of the upper support ring and the lower support ring respectively by spot welding.

4. The lamp shade in accordance with claim 3, wherein each of the connecting members has two opposite bent reinforcing walls formed on two opposite sides thereof, and the connecting tongue of each of the connecting members is located between the reinforcing walls.

5. The lamp shade in accordance with claim 4, wherein each of the reinforcing walls of each of the connecting members is perpendicular to the connecting tongue.

6. The lamp shade in accordance with claim 4, wherein each of the reinforcing walls of each of the connecting members is rested on an inner rim of each of the upper support ring and the lower support ring respectively so that the two reinforcing walls and the connecting tongue of each of the connecting members form a three-point contact with the upper support ring and the lower support ring respectively, and each of the connecting members is secured on the upper support ring and the lower support ring respectively by support of the reinforcing walls and the connecting tongue.

7. The lamp shade in accordance with claim 4, wherein the connecting tongue has a width smaller than that of each of the connecting members so that the connecting tongue is separated from the reinforcing walls of each of the connecting members.

8. The lamp shade in accordance with claim 4, wherein the connecting tongue of each of the connecting members is located between the reinforcing walls and extends in a direction opposite to that of the catch portion of each of the connecting members.

9. The lamp shade in accordance with claim 2, wherein the insert of each of the support bars is limited in the insertion slot of the respective connecting member and stopped by the catch portion of the respective connecting member to prevent the insert of each of the support bars from being detached from the respective connecting member of the upper support ring and the lower support ring.

10. The lamp shade in accordance with claim 1, wherein the insertion slot of the straddle portion of each of the connecting members is substantially sheath-shaped.

11. The lamp shade in accordance with claim 1, wherein the insert of each of the support bars has a size smaller than that of the insertion slot of the respective connecting member so that the insert of each of the support bars is slidable rightward and leftward in the insertion slot of the respective connecting member and is movable forward and rearward between the insertion slot and the opening of the respective connecting member.

12. The lamp shade in accordance with claim 11, wherein the insert of each of the support bars is movable in the insertion slot of the respective connecting member in a two-dimensional direction.

13. The lamp shade in accordance with claim 1, wherein the straddle portion of each of the connecting members has a substantially arch-shaped cross-sectional profile.

14. The lamp shade in accordance with claim 1, wherein each of the connecting members is integrally formed by a bent single-metallic plate.

15. The lamp shade in accordance with claim 1, wherein each of the connecting members has a substantially U-shaped cross-sectional profile.

16. The lamp shade in accordance with claim 1, wherein the connecting members are equally spaced from each other.

17. The lamp shade in accordance with claim 1, wherein the insertion slot of the straddle portion of each of the connecting members is connected to the opening and is located between the opening and the two breaches.

* * * * *